United States Patent [19]

Schwartz

[11] 3,938,119

[45] Feb. 10, 1976

[54] ELECTRO-MECHANICAL THREAD SUPERVISORY APPARATUS

[75] Inventor: Hermann Schwartz, Pfaffikon, Switzerland

[73] Assignee: Siegfried Peyer, Bach, Switzerland

[22] Filed: May 5, 1975

[21] Appl. No.: 574,399

[30] Foreign Application Priority Data

June 20, 1974 Switzerland ..... 8469/74

[52] U.S. Cl. ..... 340/259; 66/163; 139/336; 226/11; 242/37 R

[51] Int. Cl.[2] ..... G08B 21/00

[58] Field of Search ..... 340/259; 226/11, 100; 242/37 R, 37 A, 148; 57/81, 83; 66/163; 139/336, 354, 370 R, 370 A

[56] References Cited

UNITED STATES PATENTS

| | | | |
|---|---|---|---|
| 2,863,276 | 12/1958 | Breuning | 66/163 |
| 3,343,008 | 9/1967 | Bancroft | 340/259 |
| 3,521,265 | 7/1970 | Bancroft | 340/259 |
| 3,562,734 | 2/1971 | Hotchkiss | 340/259 |
| 3,611,342 | 10/1971 | Raaben et al. | 340/259 |
| 3,633,197 | 1/1972 | Dunlap | 139/336 |
| 3,688,958 | 9/1972 | Rydborn | 242/37 R |
| 3,764,773 | 10/1973 | Merkle | 57/81 |
| 3,890,810 | 6/1975 | Domig | 66/163 |

*Primary Examiner*—Glen R. Swann, III
*Attorney, Agent, or Firm*—Flynn and Frishauf

[57] ABSTRACT

A sensing lever, preferably a double-arm lever, is journalled over a fulcrum; one arm is engaged by the thread to be supervised, and further connected to operate an electrical switch; the other arm is subject to electromagnetic force derived from an interrupted, pulsed electromagnet. Pulsed operation of the electromagnet can be obtained by a signal derived from the switch of the lever itself, or from an extraneous source; upon attraction by the magnet, the contacts are opened; during a pulse gap, the thread tension depresses the lever, thus closing the contacts; the lever will, therefore, continuously vibrate and presence of an a-c signal across the switches will be indicative of: (a) presence of thread; (b) thread tension below a predetermined limit (excessive tension would overcome the pulsed reset force of the electromagnet); and (c) proper operation (jamming of the lever would likewise result in a d-c output from the switch).

10 Claims, 3 Drawing Figures

ELECTRO-MECHANICAL THREAD SUPERVISORY APPARATUS

BACKGROUND OF THE INVENTION

The present invention relates to an electro-mechanical thread or yarn supervisory apparatus to check for the presence or absence of thread being supplied to a textile machine, for example to a spooling machine or the like, and having a mechanical element which is in physical contact with the thread to be supervised.

Thread supervisory apparatus are used in many branches of textile manufacture. Such apparatus check for the presence of a thread and provide a signal if the thread should fail to be detected, so that the production machine to which the supervisory apparatus is coupled may be stopped. Such apparatus is also at times referred to as a "stop motion" device. Three main groups or categories of thread supervisory apparatus are in common use: mechanical apparatus, electro-mechanical apparatus, and purely electrical apparatus.

The mechanical thread supervisory apparatus use a lever system in which the thread or yarn directly controls machine function. Such a system requires precise bearing of the mass to be moved. The mass to be moved, itself, is comparatively great, which results in apparatus which is generally slow and unreliable.

Electro-mechanical thread supervisory apparatus also usually use a lever system which can be constructed to be much lighter, however, than the lever system of purely mechanical apparatus. The lever system only operates an electrical contact. A magnet which forms part of the machine is energized, directly or by means of a relay, the magnet then operating a magnetic clutch, an electric brake, or the like to effect stop motion of the machine.

Purely electrical and electronic stop motion devices do not require movable parts. The thread is sensed without contact therewith, either photoelectrically or capacitatively. So-called operating thread sensors are effective only when the thread is in motion. Small variations in uniformity of the spun thread are used to obtain the signal, so that, during running of the thread, an aperiodic alternating signal is obtained. Such signals are usually not available when the thread is a monofilamentary synthetic thread made with high precision, since such threads are highly uniform. The utility of electronic thread sensors is thus limited and, additionally, such sensors are considerably more expensive than other types.

Mechanical thread sensors have a wide field of utility when many runs of threads are to be supervised, for example in machinery which uses 1,000 to 2,000 threads, for example warp threads of looms.

Mechanical thread supervisory apparatus operate by having a thread engage a rotatably journalled sensing lever by being looped thereabout over a certain looping angle, pressing the lever in a predetermined position. If the thread breaks, a weight or a spring, providing a reset force, becomes effective, returning the sensing lever into a rest position, thus triggering a control signal for the machine. To change the position of the sensing lever into the supervisory position, it is therefore necessary to overcome not only a certain distance, but also a certain reset force. The force with which the thread presses on the lever must be at least slightly above this reset force. This force must be applied by the lever corresponding to a sine function of the looping angle, and must be available by virtue of thread tension in the machine; the maximum force is determined by the maximum permissible thread tension in the running direction of the thread.

Mechanical or electro-mechanical supervisory apparatus in current use require an application pressure on the sensing lever of at least 2 grams. If the reset force is substantially decreased, then small extraneous influences or operating parameters, such as dirt, friction or the like may interfere with proper operation. The reset force, and thus the stop motion action of the sensor also become slow, which is not acceptable in high thread supply speeds.

Thin synthetic threads, typically monofilamentary threads, are currently used in textile machinery with thread tension of only 2 to 3 grams. A thread sensor having only 2 grams pressure would then require the thread to be carried thereabout with a looping angle of 90°. This is frequently impossible from a machinery design point of view and, additionally, may lead to damage of the thread, due to roughing or stretching of the thread. Acceptable looping angles are between 10° to 15°. As a result, however, only one fifth of the thread tension is available on the average to operate the thread supervisory sensor. A thread sensor for thin synthetic threads should, therefore, operate with an application pressure of less than 0.5 gram while still operating reliably and quickly.

All mechanical thread sensors have an additional disadvantage and that is the lack of self-supervision. The thread sensor may fail to stop the machine if the sensing lever is impeded in its freedom of movement, for example by dirt, bending, fluff, slubs, remnants of thread, or the like. Frequently this condition is not discovered until hours later, and then only by chance; in the meanwhile, imperfect textile material has been produced, so that high losses in supplies, materials and production may result. The thread sensor should, therefore, operate in such a manner that is continuously supplies an output signal, even when the thread is proper, and also when its sensing element is impeded in free movement, thus stopping the machine, so that defective thread supervisory apparatus can be replaced in time.

All presently available thread sensors only respond when the thread is entirely missing, or when the thread tension is below the reset force. If, however, the thread should not feel properly, for example due to a defective thread brake, poor spooling, formation of slubs, kinks, or the like, then the thread tension will rise substantially beyond its proper value. This condition is also a substantial defect, which should be signalled, since it may lead to stretching of the thread and hence poor quality of the resulting product. It is thus important in many applications that the thread sensor respond not only when the thread tension disappears, for example due to breakage, but also when a tolerated design upper limit of the thread tension is exceeded.

It is an object of the present invention to provide an electro-mechanical thread sensor which has sufficient reset force in spite of extremely light thread application pressure, which is self-supervisory and which responds not only when there is a breakage in thread, but also when the thread tension becomes excessive.

SUMMARY OF THE INVENTION

Subject matter of the present invention:

Briefly, a sensing lever or sensing arm has the thread looped thereabout through a limited looping angle. The arm is responsive to a magnetic field providing the reset force. Electromagnetic means, providing the field, act on the arm in a direction counter to the pressure exerted on the arm by the thread. The electromagnetic means are pulse-energized to cause the arm to vibrate. The arm is further connected to switch means, the operation of which is controlled by deflection of the arm during pressure of the thread on the arm and effective to generate an electrical pulse signal. An electrical detection circuit is connected to the switch means responsive to generate electrical pulses as controlled by the switch means, the electrical pulses being representative of vibration of the arm. Upon failure of the pulses, that is, upon failure of vibration due to the interplay of pulsed reset magnetic forces and the thread tension forces, an alarm signal can then be generated stopping the machine.

In accordance with a feature of the invention, the lever is a double-armed lever journalled to rock about a fixed axis; one arm forms the armature of an electromagnetic arrangement to generate the vibrating or oscillating movement of the arm, in pulses, and counter the pressure force of the thread when being attracted by the electromagnet; the other arm forms a switching element which provides the electrical pulses in dependence on vibration, or oscillation of the arm, the pulses being connected to an electronic circuit to generate the alarm signal upon failure of vibration or oscillation of the arm.

This arrangement permits construction of a thread supervisory apparatus having very low application pressure, for example in the order of tenths of a gram, since the application pressure need overcome only very small forces, for example, bearing friction on the sensing lever or arm. The electromagnetic arrangement can be suitably designed to provide a reset force of suitable strength which can be readily controlled, so that the reset force can be matched to different thread conditions and various thread tension ranges. Since the reset of the sensing arm is intermittent, and since the alarm signal is generated upon failure of vibration of the sensing lever, the thread sensing arrangement is self-supervising, since vibration is interrupted not only if the thread should break, or if the thread should have excessive tension, thus preventing vibration, but also if there is any interference with free movement of the sensing arm or lever.

BRIEF DESCRIPTION OF THE DRAWING

The invention will be described by way of example with reference to the accompanying drawings, wherein.

DESCRIPTION OF THE PREFERRED EMBODIMENTS

Figure 1:
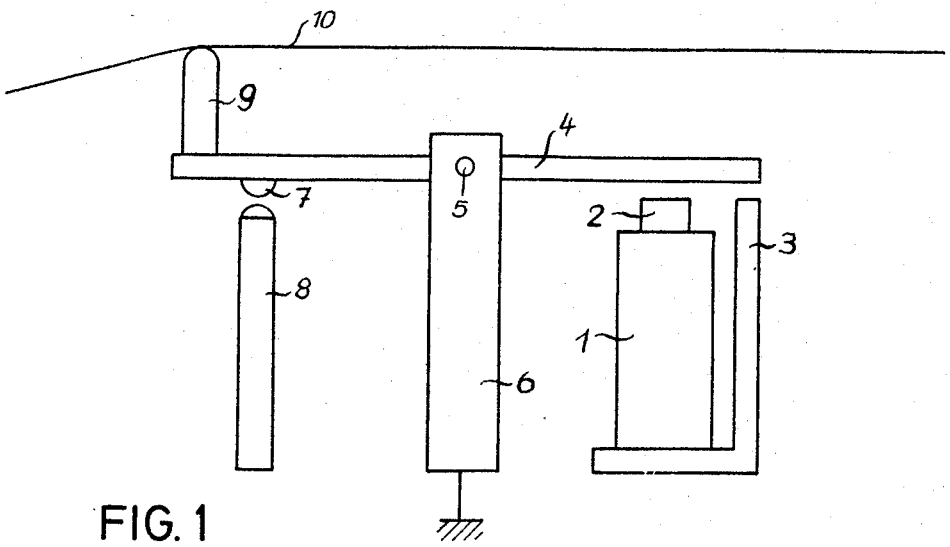
FIG. 1 is a highly schematic side view of the thread supervisory apparatus.

The electro-mechanical thread supervisory apparatus of FIG. 1 is illustrated in schematic, simplified form, in which elements not necessary for a complete understanding of the invention have been omitted. This arrangement is complete in itself, and operative. It is so arranged that, absent any forces acting on the double-arm lever 4, lever 4 is in balance about its rocking axis, or shaft 5. The bearing for shaft 5 should, therefore, be carefully constructed, for example in form of an edge bearing similar to a lever scale.

The double-arm lever 4 is made of iron, and its stub shaft 5 is journalled in a bearing which, in turn, is attached to a metal fork 6 secured to the frame of the machine and electrically grounded. An electromagnet is located opposite one end of arm 4; the electromagnet has a coil 1, a core 2, and a yoke 3. The other end of the lever 4 has an electrical contact 7 secured thereto, located opposite a fixed contact 8. The upper side of the contact end of lever 4 has a thread guide 9 secured thereto, which is in contact with thread 10. Thread guide 9, preferably, is a ceramic element over which the thread 10 can run, with a small looping angle, in the order of from 10° to 15°, for example.

Basic operation: Due to application pressure of the thread 10, lever 4 is pressed downwardly, thus closing contacts 7 and 8. A circuit (which will be explained in connection with FIGS. 2 and 3) between fork 6 and shaft 5 and hence arm 4 will then be closed. The magnet coil 1 is connected to a source of electrical power through this circuit and, upon being energized, will exert a relatively high reset force on the lever 4. This will immediately open contacts 7 and 8, thus interrupting current through coil 1, and releasing the reset force. This again permits closing of the contacts 7 and 8 by the tension of thread 10 looped over the guide 9 to its limited extent, thus re-closing contacts 7 and 8, and the cycle will repeat.

Upon sensing of thread 10, with proper tension and in proper position, lever arm 4 thus constantly rocks slightly about its shaft 5. An amplifier is included in the circuit, and to disconnect the low voltages necessary, only a very small air gap between contacts 7 and 8 is necessary. Movement of the lever 4 may be very small, for example may have a value of at the most 0.01 mm, corresponding to a hardly noticeable vibration. The frequency of vibration is essentially determined by the mass of the lever 4 and in practical embodiments is in the range of between 100 to 200 Hz. In a practical example, the distance between shaft 5 and contact 7 on the lever 4 was:

20 mm; the overall length of the lever 4 was:

50 mm.

If the application pressure on lever 4 at the contact end 9 disappears, for example due to breakage of the thread, then the contacts 7 and 8 will remain open upon the last reset pulse; vibration ceases. Conversely, if the thread tension should become excessive, and greater than the magnetic reset force, contacts 7 and 8 can not open anymore, and likewise vibration ceases. Should lever 4 become jammed and not capable of free movement anymore, contacts 7 and 8 will either not close, or will remain constantly closed. Under all the above conditions, vibration of arm 4 is impeded. Thus, upon termination of interrupted current flowing through contacts 7, 8, stop motion of the machine is triggered. The reset force through coil 1 depends only on the current through the coil; by use of a variable voltage source, therefore, the turn-off point for excess thread tension can be freely selected. If the looping angle of the thread 10 over the guide 9 is constant, a volt meter connected across coil 1 and connected to a variable power supply can have a scale indicating directly various thread tension values; such a voltage may, of course, simultaneously control a plurality of similar thread supervisory apparatus. The thread supervisory apparatus is self-supervisory since failure of the arm 4 to vibrate, for example due to extraneous influences, will also lead to stopping of the machine.

Magnet coil 1 requires supply of some power; the current through contacts 7, 8 should be very small and, therefore, in a preferred form, very low current only is switched by contacts 7 and 8, to which an amplifier is connected. Contacts 7 and 8 may switch only a few micro amperes and, therefore, even substantial changes in switching resistance will not interfere with operation of the device.

Figure 2:
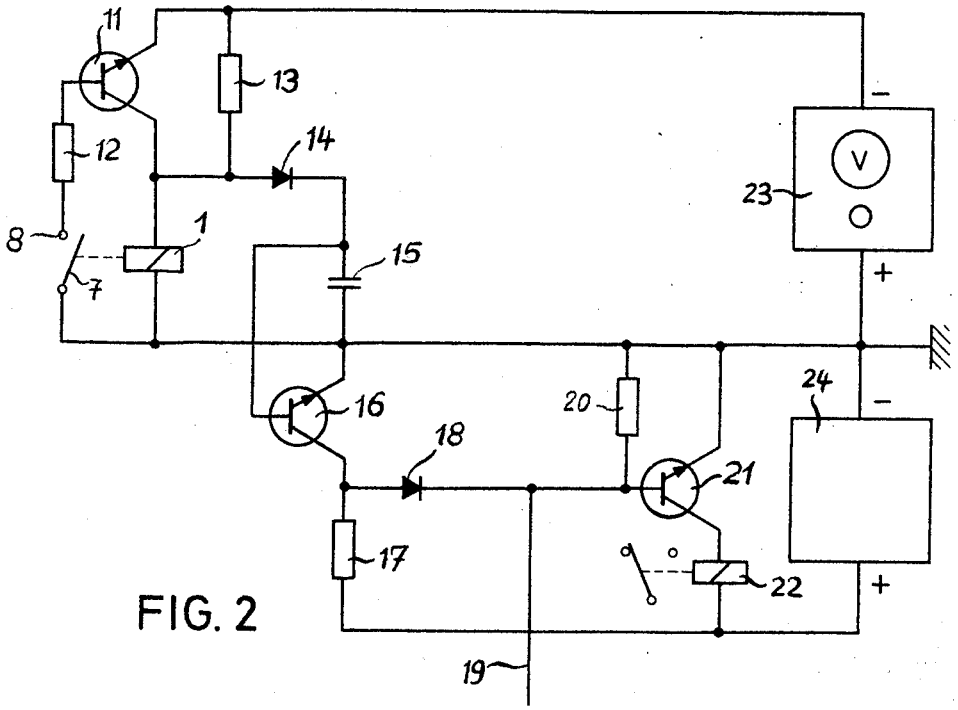
FIG. 2 is a schematic circuit diagram of the supervisory apparatus of FIG. 1.

A particularly simple circuit to control the apparatus of FIG. 1, and to provide an alarm signal, is illustrated in FIG. 2: Contact 8 is connected through a base resistor 12 to the base of a transistor 11 operating as an amplifier. Transistor 11 switches the magnet coil 1, schematically indicated in FIG. 2. A resistor 13 is connected in parallel to the transistor 11, so that even if contacts 7 and 8 are open, a small current will flow from source 23 through coil 1, to provide a small magnetic reset force and thus a predetermined positive zero position of the arm 4, even upon presence of machine vibration.

A self-induced voltage is generated when current is disconnected from a coil. This voltage has reverse polarity, and is applied by diode 14 to a capacitor 15 to there serve as a control voltage for the base of a transistor 16. Upon continuous vibration of arm 4, and hence continuous interruption and re-connection of current through coil 1, a control voltage will be continuously applied to transistor 16 over capacitor 15 which will remain in conductive state. Resistor 17 then will have a negative voltage appear thereat, supplied by a further source 24, so that no current can be applied over diode 18 to the base of a transistor 21, and across resistor 20. If, due to some defect, vibration of arm 4 should cease, no change in voltage will occur across capacitor 15, so that the capacitor can discharge over the base of the transistor 16, until transistor 16 reaches blocking state. The positive voltage of source 24 will then appear at resistor 17, which is conducted over diode 18 to the resistor 20, causing transistor 21 to become conductive and energize a relay coil 22 which is connected to a switch to stop the machine to be supervised.

If the machine has only a single stop-motion circuit, but a plurality of thread supervisory apparatus are used, only a single relay 22 and transistor 21 are needed; all the outputs provided by the diodes 18 from the various thread sensors can be connected to a common bus 19, any one of the thread sensor circuits controlling transistor 21 and hence stop motion of relay 22.

The sensing lever or arm 4 requires only a very small path to open contacts 7 and 8. Thus, interruption is rapid, about 2–3 milliseconds. The stop-motion time is essentially determined by the value of the capacitor 15, the size of which can be so dimensioned that stop-motion times of 20 to 30 milliseconds are obtained.

The system of FIG. 2 operates with two voltage sources: source 24 having a fixed voltage, for example 12 V, and controlling relay 22 as well as supplying transistor 16; and a variable voltage source 23, which may vary between 2.5 to 25 V, depending on the maximum reset force desired to supervise for excessive thread tension. If adjustable supervision of thread tension is not necessary, then voltage source 23 may also have a fixed value which, however, should then be so selected that the resulting current through coil 1 will result in a magnetic force which will exceed the highest expected thread tension.

Switch contacts 7, 8 have been illustrated as mechanical contacts; they may, of course, also be photoelectric contacts, magnetic proximity contacts, or the like, or capacitative couplers.

Figure 3:
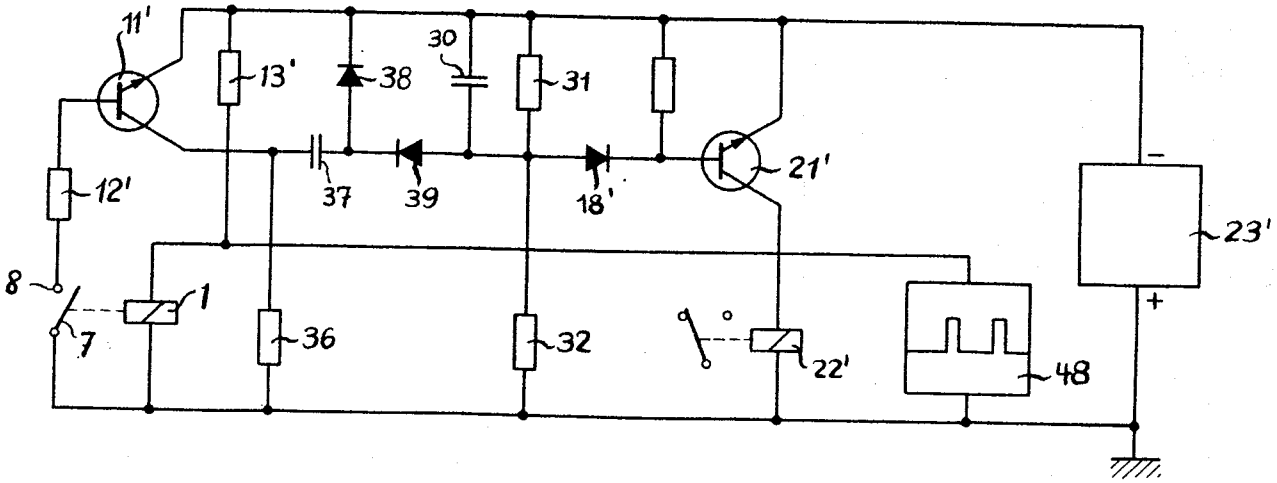
FIG. 3 is a schematic circuit diagram of another embodiment of a circuit arrangement for the apparatus of FIG. 1.

The circuit of FIG. 2 provides for pulsed connection of the reset magnet by inherent control of the magnetic system over contacts 7 and 8, so that the vibrating frequency of the lever 4 is determined by the size and inertia of the entire vibrating system. FIG. 3 illustrates a different embodiment, in which contacts 7 and 8 do not control interruption to coil 1, but only provide the necessary alarm signal for supervision of the thread tension. Coil 1 is fixedly connected to a pulse generator 48, generating a series of pulses (schematically indicated by the wave form within block 48) so that, depending on the distance between pulses, or on pulse spacing, electromagnetic reset forces will become effective on the arm 4. The bias current applied through resistor 13' and constantly effective on coil 1 is again very small, so that the arm 4 can be brought in the closing condition of contacts 7 and 8, even with small application pressure due to the thread 10. At the next pulse delivered from generator 48, the coil 1 is energized through the pulse source 48, thus providing a strong reset pulse, opening contacts 7, 8. The opening path, and time, are determined by the pulse duration and pulse spacing. A source 23' is connected in parallel to the series circuit of coil 1 and resistor 13'.

The basic principle again is the same; under action of thread tension, contacts 7 and 8 are first closed with small force and then are again re-opened with a strong reset force; the frequency selected may, for example, be power frequency such as 50 Hz, 60 Hz, or a low multiple thereof.

Contacts 7 and 8 are connected in series with a resistor 12', connected to the base of transistor 11', and control conduction of the transistor 11' in accordance with pulse frequency; resistor 36 will, then, have a square wave alternating voltage appear thereat, forming the signal if the thread properly passes over the thread sensor. Presence of this alternating voltage across resistor 36 may be utilized for further control or indication. This voltage is coupled by capacitor 37 to diodes 38, 39 where it is rectified, so that capacitor 30 can be charged negatively. Negative charge on capacitor 30 will balance a positive voltage provided by the voltage divider formed of resistors 31, 32, thus blocking diode 18', and causing continued blocking of transistor 21', and hence leaving relay 22' de-energized. Upon interruption of vibration, for example due to breakage of thread, excessive tension, or blockage of movement of the arm 4, alternating voltage across resistor 36 ceases, thus permitting discharge of capacitor 30 and application of a positive voltage over diode 18' to the base of transistor 21', which, in turn, actuates relay 22'. The embodiment of FIG. 3 has some advantages over that of FIG. 2: The switching power required to be switched over contacts 7 and 8 is decreased and thus higher switching resistances can be tolerated, further substantially increasing the life of the contacts. The pulse voltage applied to the coil 1 can be substantially increased and is no longer limited by output available from transistors, the operating voltage of which under reasonable economic conditions usually does not exceed 30 V. The frequency of the a-c output signal becomes independent of the mass of the lever 4.

Various different kinds of electronic circuits can be constructed; it is important, only, that the forces required to close contacts 7 and 8, under command of movement of the lever 4, be very small and derived from the thread tension, whereas the reset forces applied electromagnetically are much greater, and substantially greater than the force applied by the thread, the reset forces being in pulses or periodically occurring form. This ensures rapid and reliable disconnection. The sensor is self-supervisory since the operation of the sensor is continuously checked due to the continuous cyclical operation of the arm when the sensor is operating properly; defects occurring at the sensing lever, or at the contacts, or anywhere in the system are thus signalled even if the thread is in order.

Various changes and modifications may be made within the scope of the inventive concept.

(1) It is not necessary that the lever be a double-arm lever supported and journalled as in FIG. 1; the arm 4 may be retained at an end, and the position of the magnetic system changed relative to the journal point, as well as the contacts 7, 8. (2) The lever need not be journalled in a rocking-type bearing but arm 4 may be constructed as a reed spring which can freely vibrate, being clamped at one end, or being clamped at a node point. By suitable selection of the material and length of such a spring, spurious vibration introduced, for example, by machine vibration can be eliminated.

(3) To indicate which one of the thread supervisory apparatus is not vibrating, an output signal can be coupled from the left side of diode 18, or 18', respectively, and conducted to an indicator (such as a luminescent diode) through an inverting amplifier-transistor to light upon failure of voltage blocking the voltage derived from source 24 (FIG. 2) or voltage divider 31, 32 (FIG. 3), respectively.

I claim:

1. Electro-mechanical thread supervisory apparatus having a deflectable mechanical arm (4) in contact with the thread (9) being supervised and deflected by pressure by the thread on the arm, comprising electromagnetic means (1, 2, 3) acting on the arm in a direction counter the direction of pressure force exerted on the arm (4) by the thread (9), said arm being magnetically responsive to said electromagnetic means, said electromagnetic means being pulse-energized to cause the arm to vibrate;

arm movement sensing means (7, 8) connected to a source of electrical power (23, 23') and controlled by deflection of the arm due to pressure of the thread on the arm and generating pulses upon vibration of the arm (4);

and electrical detection means (15, 16, 17, 18; 37, 38, 39, 18') connected to and responsive to the generated electrical pulses and providing an alarm signal upon failure to sense vibration of the arm and thus generate pulses indicative of: (a) absence of thread; or (b) excessive thread tension; or (c) jamming of movement of the arm.

2. Apparatus according to claim 1, comprising a support (6) having a bearing and wherein the arm (4) is a lever journalled (5) in the bearing for rocking movement with respect to the support.

3. Apparatus according to claim 1, comprising a support (6) having a bearing therein and wherein the arm comprises a two-arm lever pivotally journalled (5) in the bearing at a location intermediate its length, the thread engaging one arm of the two-arm lever and the electromagnetic means acting on the other arm of the two arm lever.

4. Apparatus according to claim 1, wherein the arm movement sensing means comprises a switch contact (7) carried by said arm and a fixed contact (8) engageable by the switch contact (7) and a support (6) is provided holding said arm, said support forming one terminal connection for said arm movement sensing means.

5. Apparatus according to claim 3, wherein the arm movement sensing means comprises a switch contact (7) secured to said one arm (4), said one arm being electrically connected through said bearing to said support (6), and a fixed contact (8) engageable by the switch contact (7).

6. Apparatus according to claim 1, wherein the arm movement sensing means (7, 8) are connected in circuit with the electromagnetic means, the generated electric pulses, upon vibration of said arm (4), pulse-energizing the electromagnetic means (1–3).

7. Apparatus according to claim 1, further comprising a pulse source (48) connected to the electromagnetic means (1–3).

8. Apparatus according to claim 1, further comprising electrical bias current means (13, 13') connected to the electromagnetic means (1–3) and providing continuous electrical bias power thereto to provide a positive reset force to the arm (4) and prevent spurious vibration of the arm upon absence of or breakage of thread.

9. Apparatus according to claim 1, wherein the electrical detection means comprises a sensing circuit (14, 15, 16; 37, 38, 39) responsive to alternating current only and switched by said arm movement sensing means (7, 8);

a "normally ON" alarm circuit (20, 21, 22; 21', 22') and a blocking connection (18, 18') disabling said "normally ON" alarm circuit when the sensing circuit senses presence of an a-c signal provided by vibration of the arm.

10. Method to supervise supply of a filament at a predetermined tension at a supervisory location by a supervisory apparatus, and additionally supervise operation of said apparatus, said method comprising: generating a thread presence force of a first magnitude, by engaging the thread;

generating a counteracting electromagnetic force, in recurring pulses, which is larger than said thread presence force;

balancing said forces against each other and generating a resulting output signal, said output signal being interrupted when the thread presence force counteracts the pulsed electromagnetically generated force during pulse gaps, but becoming a constant signal upon the absence of said thread presence force during said pulse gaps;

and testing if the sensed signal is an interrupted signal or a constant signal, and providing an alarm output if the signal is not an interrupted signal.

* * * * *